United States Patent [19]

Pierrel et al.

[11] 4,236,571

[45] Dec. 2, 1980

[54] PROCESS AND INSTALLATION FOR THE CONTINUOUS CASTING OF TUBULAR PRODUCTS

[75] Inventors: Michel Pierrel; Rio Bellocci, both of Pont-a-Mousson, France

[73] Assignee: Pont-a-Mousson S.A., Nancy, France

[21] Appl. No.: 5,895

[22] Filed: Jan. 23, 1979

[30] Foreign Application Priority Data

Jan. 27, 1978 [FR] France ..... 78 02277

[51] Int. Cl.[3] ..... B22D 11/00

[52] U.S. Cl. ..... 164/85; 164/421

[58] Field of Search ..... 164/85, 252, 338 R, 164/338 M, 338 H, 421

[56] References Cited

U.S. PATENT DOCUMENTS

| | | | |
|---|---|---|---|
| 2,473,221 | 6/1949 | Rossi | 164/85 |
| 3,698,470 | 10/1972 | Fink | 164/85 |
| 3,710,840 | 1/1973 | Fabens, Jr. | 164/85 |
| 3,763,926 | 10/1973 | Tschinkel et al. | 164/60 |
| 4,034,798 | 7/1977 | Boggs et al. | 164/85 |

*Primary Examiner*—Robert D. Baldwin
*Assistant Examiner*—K. Y. Lin
*Attorney, Agent, or Firm*—Sughrue, Rothwell, Mion, Zinn and Macpeak

[57] ABSTRACT

The process is particularly intended for the casting of thin tubes of iron in a vertical annular die defined by a mould and a core. It comprises maintaining in the liquid state metal under pressure poured into the die and in contact with the core so as to create a substantially frustoconical solidification front which extends from a point of the wall of the mould in the vicinity of the input end of the die and reaches practically the lower end edge of the core. The installation for carrying out this process comprises a heating device inside the core and a liquid metal jacket under pressure which surrounds the mould and is surrounded by a water cooling jacket.

9 Claims, 7 Drawing Figures

PROCESS AND INSTALLATION FOR THE CONTINUOUS CASTING OF TUBULAR PRODUCTS

The present invention relates to the continuous casting of tubes of ferrous alloys such as steel or a non-ferrous alloy such as aluminium or copper alloys, and more particularly to the continuous casting of iron tubes having a thin wall.

At the present time, it is known how to continuously cast in a vertical direction solid section members and even hollow section members such as tubes having great thickness, that is to say a thickness exceeding 15 mm. Unfortunately, this process has the drawback of a low production rate since the output of the cast product is substantially lower than that of a discontinuous casting, for example by the centrifugal casting of iron pipes.

This low production rate is essentially due to the fact that tearing of the metal must be avoided, this tearing being liable to occur at each instant owing to the pull exerted on the cast product by the extracting device. Consequently, the cast product must be pulled very slowly, step by step, and a supply of liquid metal must be furnished in a substantially continuous manner, in order to close or fill in the cracks or tears which have a tendency to occur.

The low production rate of casting dies of conventional design is moreover due to a lack of effectiveness and homogeneity of the cooling. The dies intended for casting tubes or hollow blanks are generally made from graphite and comprise a mould or an ingot mould and a core or mandrel defining therebetween an annular space and mounted with an interference fit inside a sleeve constituting a water jacket. Now, it has been found that the thermal contact is imperfect since it is interrupted in regions by films or regions of insulating air. Consequently, the position of the solidification front, that is to say the liquidus-solidus interface of the poured metal, varies considerably in an uncontrollable manner for quite normal or usual variations in the various casting parameters.

These variations may be acceptable for the casting of thick tubes but become unacceptable for the casting of thin tubes, for example when the thickness is only a few millimeters. Indeed, in this case, there is a danger of an escape of the liquid metal under the casting die or premature solidification within the casting die which results, by the shrinkage around the core, in an actual gripping of the core and consequently a blocking of the descent of the cast tubular product. In any case, it is impossible to start up the continuous casting of a thin metal tube by means of such casting dies.

An object of the present invention is to overcome this problem by providing a process and installation for continuously casting more particularly tubes having a thin wall.

According to the invention, there is provided a process for continuously casting in a vertical descending direction, tubes of iron or other metal alloy in an annular casting die defined between a mould and a core of graphite, comprising supplying the die with liquid metal under pressure, maintaining the metal in contact with the core of the die in the liquid state while facilitating the solidification of the metal in contact with the mould and thereby creating in the annular space of the die a solidification front of the liquid metal extending from a region of the wall of the mould which is relatively close to the input end of the die to a point of the core located substantially at the output end of this die.

In one embodiment, the core is heated internally on the major part of its length but maintained cold at the end thereof corresponding to the output end of the die.

Preferably, the cooling of the mould is effected by two successive jackets, namely one of liquid metal having a low melting point and the other of circulating water.

Owing to the supply of the metal under pressure, and to the regulation of the temperature of this metal in the die, that is to say to the combination of the maintenance of the metal in the liquid state in contact with the core and the cooling of the metal in contact with the mould, the solidification front is maintained in a position which is substantially constant and easily controlled. Consequently, the risk of escape of the liquid or of the blocking of the solidified metal and the formation of tears are practically avoided.

Another object of the invention is to provide an installation for carrying out the foregoing process.

According to the invention, there is provided an installation comprising a casting die of graphite including a mould and a core defining therebetween an annular casting space, a pouring basin in the upper part of the die and rollers for guiding and extracting the tubular product which has been cast and has solidified in the lower part of the die, wherein the core of the die comprises externally means for heating its outer surface extending on the major part of the length thereof, the mould is surrounded externally by a jacket of liquid metal having a low melting point placed inside a water jacket and the annular space between the core and the mould is connected to the upper pouring basin which is maintained under pressure.

In one embodiment, the core and the mould are placed vertically, the pouring basin being in their upper part and the extracting device in their lower part so that the liquid flows in the die under the combined effects of gravity and pressure prevailing in the pouring basin.

The risk of tearing and the phenomena of blocking or escape of metal are thus avoided, so that it is possible to start up the casting of tubes having a thin wall which does not exceed a few millimeters thickness and of course to continue this casting.

The ensuing description of embodiments, given merely by way of non-limitative examples and shown in the drawings, will bring out the advantages and features of the invention.

Figure 1:
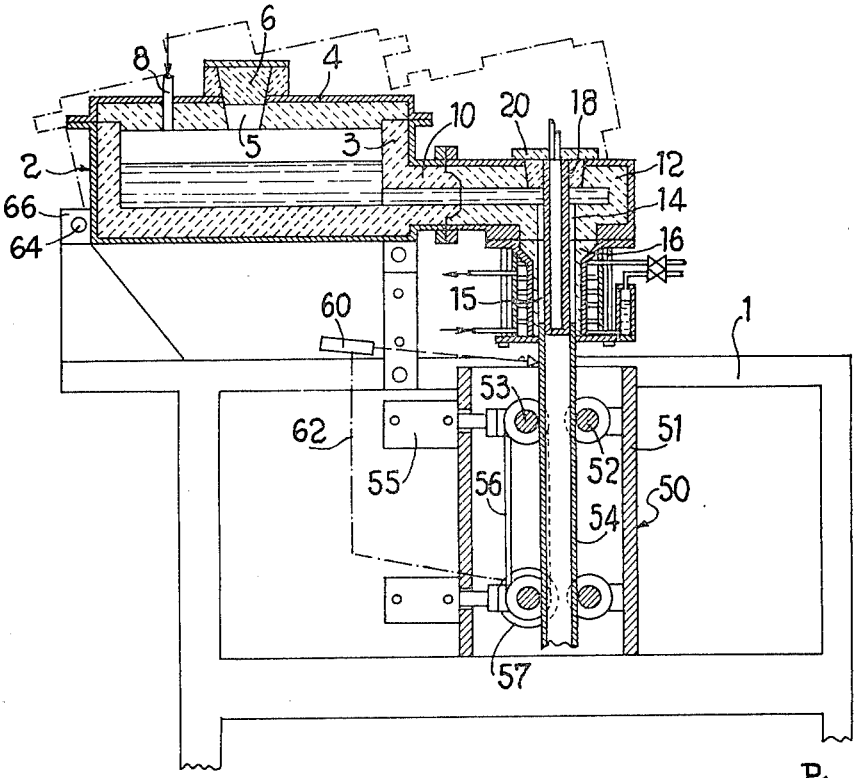
FIG. 1 is a diagrammatic elevational view, with a part in section, of an installation for continuously casting tubular products according to the invention, in the course of operation.

As shown in FIG. 1, the installation for continuously casting tubular products according to the invention comprises a stand 1, preferably formed by a metal framework, which supports in its upper part a pouring vessel or ladle 2. The vessel 2 has a refractory lining 3 and is closed hermetically by a cover 4 which is provided with a filling orifice 5 closed by a plug 6 and has extending therethrough a pipe 8 connected to a source of gas under pressure (not shown), for example a tank containing neutral gas such as nitrogen.

At the level of its bottom, the pouring vessel is extended by a pouring nozzle 10 to which a pouring head 12 is fixed in a sealed but detachable manner. The pouring head 12 is of the type having an L-shaped pouring passage, that is to say a passage comprising two passages 13 and 14 at a right angle. One of the passages, 13, extends the pouring nozzle 10 and the other passage 14 opens onto the interior of a die 15 defined by an annular space between a mould 16 and a core 18.

Figure 3:
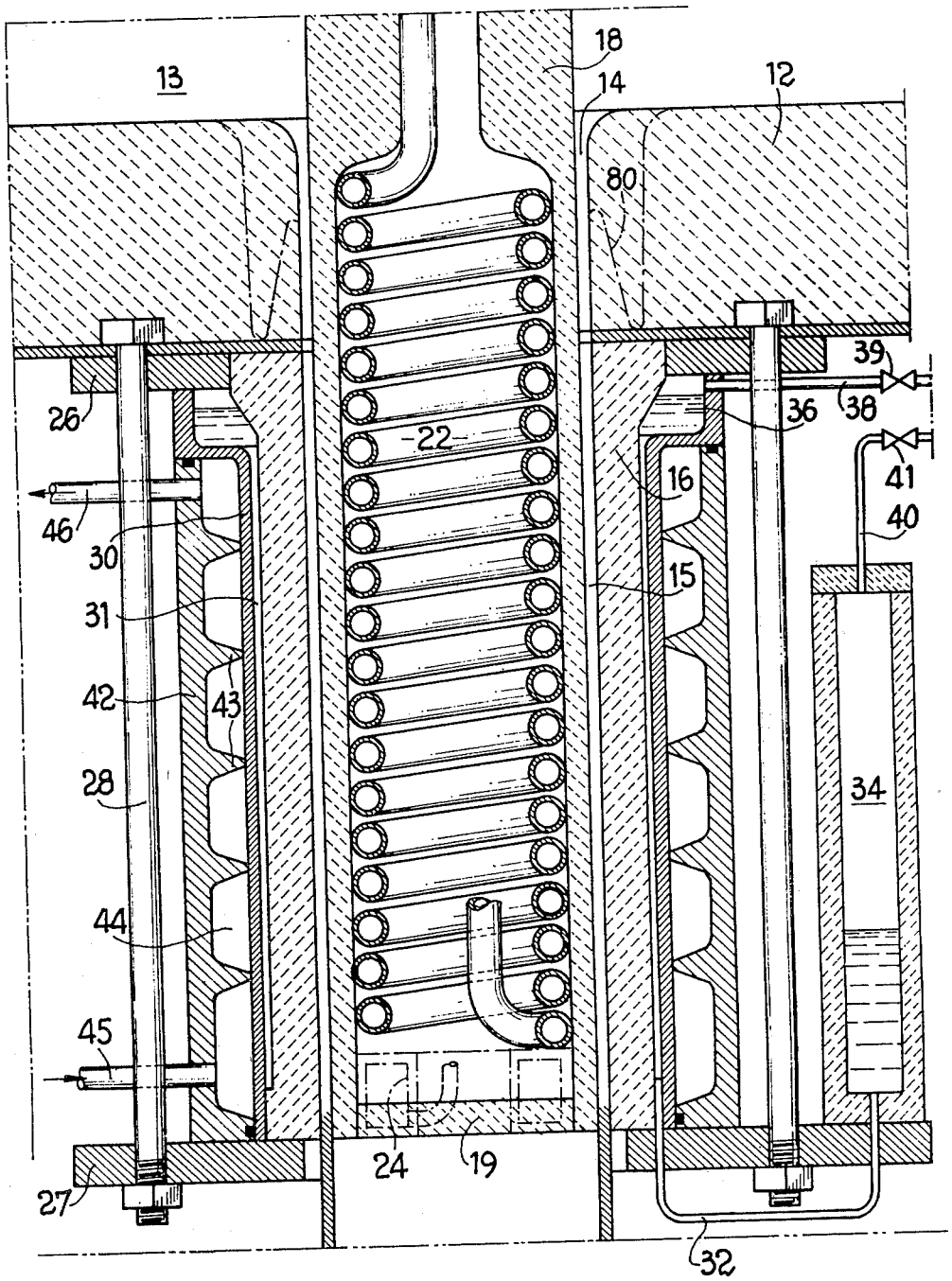
FIG. 3 is a diagrammatic sectional view, to an enlarged scale, of the tubular casting guide of the installation shown in FIGS. 1 and 2.

The core 18 is formed by a hollow cylinder of refractory material such as graphite which is closed at its lower end by a bottom wall 19 but has an open upper part. This upper part is rigid with a flange 20 for fixing it to the upper part of the pouring head 12. Mounted inside the core 18 is a heating device 22 (FIG. 3) which is, for example, an induction heating device, such as a coil or an inductor, or a heating device employing the Joule effect, for example a heating resistance. In the illustrated embodiment shown in FIG. 3, this device comprises an inductor 22 having a serpentine shape cooled by water. The coiled inductor 22 is wound helically against the inner wall of the core 18 and comprises a return branch which is substantially on the axis of this core. The outlet and inlet ends of the coiled inductor are connected outside the core to a source of electric curent (not shown), for example a source providing an electric current having a frequency of 10,000 Hz. The coiled inductor 22 extends over the major part of the core 18 but does not reach the bottom 19. Indeed, the lower part of the core 18 is always devoid of heating. In one embodiment, there is even provided against the bottom wall 19 a cooling device, for example a vessel of annular shape in which cooling water circulates, such as that shown in dotted lines at 24 in FIG. 3.

The mould or ingot mould also has a hollow cylinder of graphite which is mounted in a sealed and detachable manner under the pouring head 12 coaxially with the core 18 so as to define with the latter an annular space 15 which constitutes the die for casting the tube and whose dimension corresponds to the thickness of the tube to be produced. The tubular mould 16 is fixed and centered by means of a flange 26 which is rendered rigid with the lower part of the pouring head 12 and with the upper part of the mould 16 and a second flange 27 which is suspended from the pouring head 12 by rods 28 and supports the lower part of the mould 16.

Also mounted between the lower and upper flanges 26 and 27 is a smooth tubular wall 30 which surrounds the mould 16 and defines around the latter a thin annular chamber or envelop or cooling jacket 31 which is connected in its lower part by a pipe 32 to a tank 34 containing liquid metal having a low melting point, for example tin. The chamber 31 is enlarged in its upper part to form a reservoir 36 which is connected, by a pipe 38 provided with a valve 39, to a source of neutral gas under pressure. Likewise, the upper part of the tank 34 is connected, by a pipe 40 provided with a stop valve 41, to a source of pressure. The two sources of pressure may be combined in a single source. The tubular wall 30 is of a metal or a metal alloy which is a good conductor of heat and has no chemical affinity for the liquid metal contained in the tank 34. For example, the wall 30 is of copper coated with a layer of aluminium produced by diffusion or with a layer of chromium deposited by electrolysis, diffusion or by other process.

The wall 30 is fitted inside a ribbed tubular wall 42 which is blocked between the bottom of the reservoir 36 and the lower flange 27. The ribs 43 of the wall 42 extend toward the outer surface of the wall 30 and are arranged to be almost in contact with this wall, a fluid passage being however provided therebetween. The ribbed wall 42 is preferably of a metal which is a good conductor of heat, for example copper or steel. An inlet pipe 45 for cooling fluid, for example water, extends through the wall 42 in the lower part of the latter and an outlet pipe 46 for this fluid extends through the upper part of this wall. The chamber 44 defined by the wall 42 and the wall 30 thus performs the function of a cooling water jacket for the mould 16, the ribs 43 improving the thermal exchange between the walls 42 and 30 of this jacket. This jacket 44 is combined with the liquid metal jacket 31 for effecting an effective and evenly distributed cooling of the mould 16.

Under the die 15 the stand 1 supports a device for extracting the solidified tube issuing from the die. This extracting device, which is designated generally by the reference numeral 50, comprises a frame 51 fixed to the stand 1. Mounted on the frame 51 are two pairs of rollers 52, 53 which have horizontal axes and define therebetween a passage for the solidified tube 54 to be extracted. One of the rollers 52 of each of the pairs is fixed, whereas the other roller 53 is mounted on the rod of a jack 55 and can consequently be moved away from the roller 52 or applied against the tube 54 with a given pressure. The rollers 53 of the two pairs are interconnected by a transmission chain 56 and driven by a motor-speed reducer unit 57 for the purpose of extracting the tube 54 (FIG. 1).

A telescope or device 60 for measuring temperature is directed at the tube 54 as it issues from the die 15. This device 60 is connected by a servo-control line 62, shown in dot-dash lines in FIG. 1, to the motor-speed reducer unit 57 and controls the speed of this motor-speed reducer unit in accordance with the temperature of the tube 54.

Figure 2:
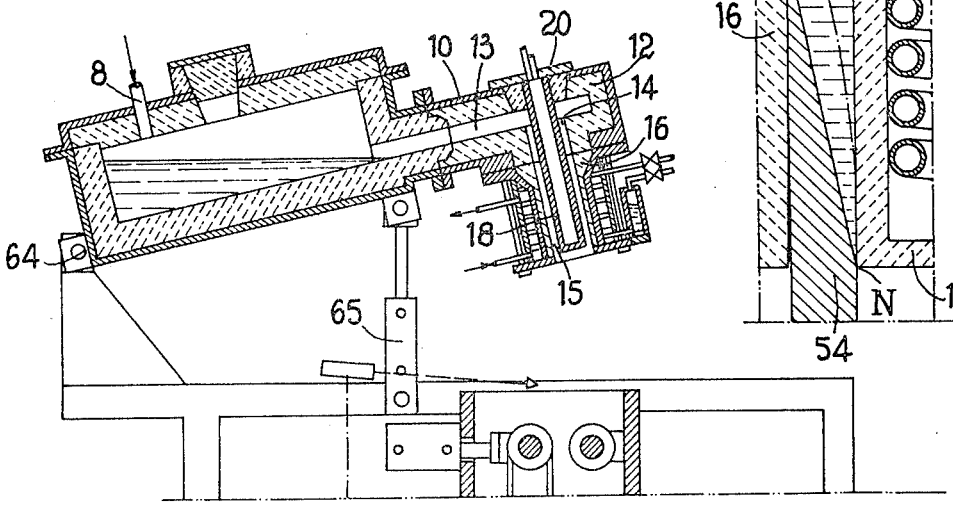
FIG. 2 is a partial sectional view of the installation shown in FIG. 1, in the inoperative position.

In the preferred embodiment shown in FIGS. 1 and 2, the pouring vessel 2 is pivotally mounted on the stand 1. It is pivotal with a pin 64 carried by bearings 66 mounted on the stand 1. A jack 65 carried by the stand 1 raises the vessel between the operative position shown in FIG. 1 and the inoperative position shown in FIG. 2. In the latter position, the pouring head 12 is at a level higher than the bottom of the pouring vessel 2 so that all the metal contained in the passage 13 is emptied into the vessel. The die 15 is also raised at the same time as the pouring head 12 so that the liquid metal does not accidentally enter the die before the start of the pouring. Preferably, in this position, the lower end of the die 15 is closed by a priming or starting up tube (not shown).

When starting the pouring, the jack 65 lowers the vessel 2 to the horizontal position shown in FIG. 1. The starting-up tube is then introduced between the rollers 52 and 53 of the extracting device 50 and the die 15 assumes a vertical position.

The heating device 22 previously heats the core 18 while the valve 39 is open so as to introduce by way of the pipe 38 gas under pressure into the reservoir 36 and the jacket 31 and thereby expel the liquid into the tank 34, the valve 41 being open so as to establish in the upper part of the tank 34, through the pipe 40, a pressure lower than that of the gas entering by way of the pipe 38. As the jacket 31 is empty, the mould 16 is also heated by the proximity of the core 18. The pouring vessel 10 is then filled with molten metal by way of the filling orifice 5 and then put under a pressure of the order of 4 bars by way of the pipe 8. The liquid iron then flows in the passage 14 of the pouring head 12 and then into the annular space 15 forming the die.

When the die 15 is filled with liquid iron, the pressures in the pipes 38 and 41 are reversed so that the liquid metal contained in the tank 34 is urged back into the jacket 31 and into the reservoir 36, then the valves 39 and 41 are once again closed. The choice of the pressures in the tank 34 and in the pipe 38 are however such that the liquid metal jacket 31 is always maintained under pressure.

Figure 4:
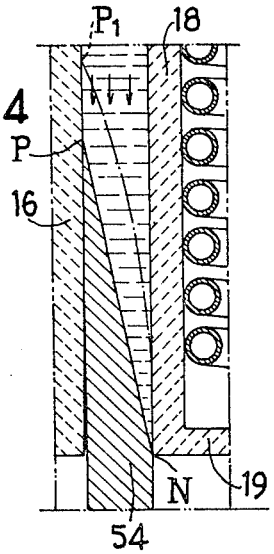
FIG. 4 is a partial sectional view of the die, showing the position of the solidification front of the liquid metal in the course of the continuous casting process according to the invention.

Owing to the heating of the core 18, the iron in contact with the latter remains practically always in the liquid state. On the other hand, owing to contact of the iron with the mould 16, which is cooled by the combination of the jacket 44 and the jacket 31, the iron here cools and tends to solidify. In this way there is produced inside the annular space 15 a solidification front constituted by the interface between the solid and the liquid and having a frustoconical shape coaxial with the core. The solidification indeed progresses from the cooled wall of the mould 16 in the direction toward the outer surface of the core 18 and reaches the latter only in its lower part, that is to say in the vicinity of the unheated part close to the bottom wall 19 of this core. FIG. 4 shows diagrammatically the position of a generatrix PN of the solidified frustum of a cone. The point N is located in the lower part of the core 18 and preferably coincides with the end edge of this core. This is obtained owing to an appropriate choice of the distance between the end of the heating device 22 and the end of the core, of the heating temperature of the device 23 and of the pressure in the pouring vessel 2. The metal poured into the die 15 is indeed subjected both to this pressure and to the effect of gravity owing to the vertical position of the die 15. The liquid iron consequently continuously and fully fills the annular space forming this die. It is in intimate contact with both the core 18 and the inner wall of the mould 16. Along the core 18, the iron is maintained at a temperature above its melting point by its contact with the heated part of the core. However, in the vicinity of the end wall 19 this heating ceases and the iron solidifies. The outer wall of the die 15 defined by the mould 16 is on the other hand cooled by the water jacket 44 which is completed by the liquid metal chamber 31 which ensures an even distribution of the cooling throughout the height of the mould and avoids irregularities due to films or regions of air.

Owing to this even cooling and to the effect of the pressure exerted on the liquid metal flowing in the die 15, the cooling of the metal and its solidification along the wall of the mould 16 occur in an extremely even and continuous manner with no risk of tearing or cracking. The shrinkage of the metal due to the solidification moves the wall of the solidified tube 54 away from the wall of the mould 16 so that this tube opposes no resistance to its extraction from the die. On the opposite side of the tube 54, as the point N is at the end of the core 18, the shrinkage occurs beyond this core so that the risk of a gripping of the core or of a blocking of the tube in the die is avoided.

It will be understood that the frustoconical solidification front NP may vary with variation in the pouring or casting parameters, but these variations are extremely limited, the point N always corresponding to the unheated part of the core, that is to say to a point close to the bottom wall 19. The front NP may, for example, shift to $NP_1$ as shown in dotted lines in FIG. 4.

As it is being formed, the tube 54 is extracted by the device 50. Its temperature is constantly controlled by the telescope or device 60 which controls the speed of the motor-speed reducer unit 57.

The rate or speed of extraction is consequently always a function of the rate of solidification so that any risk of cracks, splits or tears is avoided. It has been found that, in the process of the invention, the rate of extraction can be substantially higher than that allowed by known prior processes. Moreover, the cast iron pipe or tube produced by means of the process of the invention may have a small thickness relative to its diameter.

For example, it has been possible to produce a tube having an outside diameter of 170 millimeters and a wall thickness of 5 millimeters with a die having an overall height of 25 centimeters from liquid iron supplied under a pressure of 4 bars by using a die according to the invention having a liquid metal jacket which is 3 millimeters thick and maintained at a pressure of 0.2 bar.

Figure 5:
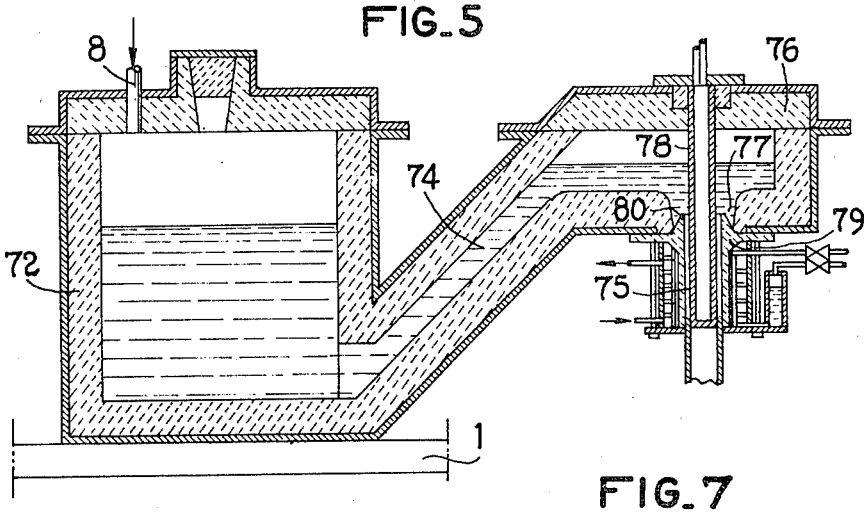
FIG. 5 is a partial sectional view of a modification of a pouring vessel for the installation shown in FIGS. 1 and 2.

It will be understood that various modifications may be made in the embodiment just described. For example, in FIG. 5, the installation may have a fixed pouring vessel 72 which is carried by the upper platform of the stand 1. Extending from the bottom of this vessel is a pouring pipe 74 which extends upwardly and communicates with a pouring head 76 in the form of a basin. The bottom of the latter is provided with a pouring orifice 77 which communicates with a die 75 which is defined between a core 78 which extends vertically through the head 76 and a mould 79 which is mounted in a sealed and detachable manner under the head 76. The die 75 is constructed and cooled in the same way as the die 15 shown in FIG. 3. However, in this case, the mould 79 is preferably extended inside the orifice 77 by a frustoconical projecting portion 80 shown in dotted-dash lines in FIG. 3. This projecting portion enables the liquid iron which must flow in the annular space 75 to be taken from a point of the pouring basin where it is hotter so as to lessen the risk of an obstruction of the pouring orifice owing to solidification of the iron. The die 75 is constantly in position above the extracting device, but at the end of the pouring, the elmination of the pressure in the pipe 8 enables the liquid remaining in the pouring head 76 to redescend into the pouring vessel 72 and clear the pouring orifice.

Figure 6:
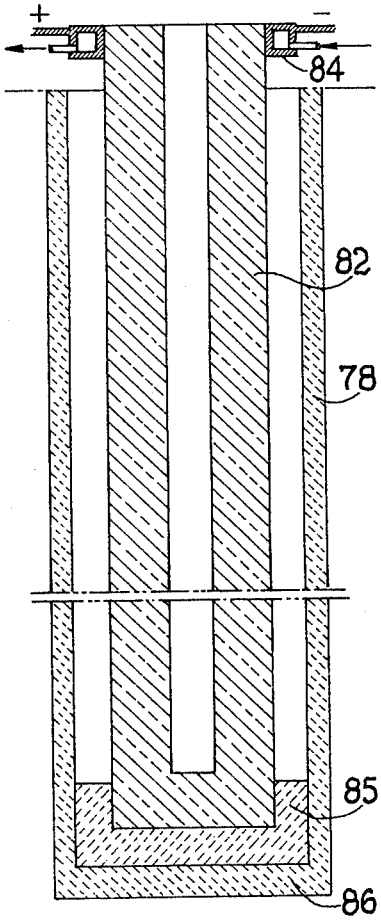
FIG. 6 is a partial sectional view of a modification of the device for heating the core of the die.

The core 78 is constructed in the same manner as the core 18 and fixed in the same way as the latter to the upper part of the pouring head 76 through which it extends. This core 78 is heated by a coiled structure similar to the device 22 or, in a modification shown in FIG. 6, by a heating resistance 82 formed by a hollow rod of graphite connected in its upper part to a circuit supplying an electric current of high intensity through a hollow copper ring cooled by a circulation of oil. This ring 84 surrounds the end of the graphite rod. In its lower part, the graphite rod 82 bears against a refractory disc 85 which insulates it from the end wall 86 of the core 78 and maintains the lower part of this core at a relatively cool temperature.

Figure 7:
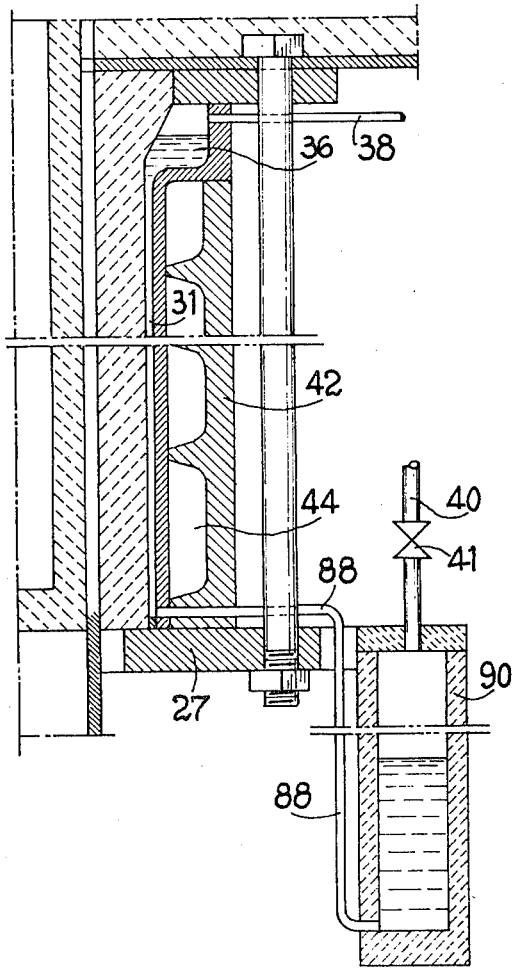
FIG. 7 is a partial sectional view of a modification of the system for cooling the mould of the die.

The mould 79, in the same way as the mould 16, is surrounded by a jacket of liquid metal 31 placed inside a water jacket 44. The jacket 31 communicates with a tank maintained at an adjustable pressure. This tank is, as in the embodiment shown in FIG. 3, a tank 34 carried by a lower flange 27 which maintains the mould 16 and may have its bottom located at a level equivalent to that of the lower part of the jacket 31. In a modification shown in FIG. 7, the jacket 31 communicates by way of a pipe 88 with a tank 90 which is located completely below the lower flange 27. In this case, the pipe 38 is merely connected to the atmosphere. The contents of the chamber 31 and the reservoir 36 are emptied into the tank 90 merely by the effect of gravity when the pipe 40 is connected to the atmosphere. Inversely, the chamber 31 is filled by putting the pipe 40 in communication with the source of gas under pressure so that the liquid is urged upwardly into the chamber 31 while the air contained in this chamber and in the reservoir 36 is discharged to the atmosphere by way of the pipe 38.

Irrespective of the embodiment employed, the combination of the supply of the liquid iron under pressure to a vertical die with the regulation of the temperature of the whole of this die according to the invention enables thin tubes to be cast continuously at a worthwhile or profitable rate.

Having now described our invention what we claim as new and desire to secure by Letters Patent is:

1. A process for continuously casting a tubular product, and more particularly a thin-walled tube, from metal in an annular die space defined between a mould and a core of graphite and having an upper input end and a lower output end, comprising continuously supplying the die space with liquid metal under pressure, while maintaining the metal in contact with the core in a liquid state while facilitating the solidification of the metal in contact with the mould by cooling the whole length of the mould and heating the major part of the length of the core while maintaining cool an end portion of the core, which end portion is adjacent the output end of the die space and within the die space, thereby producing in the annular die space a solidification front of the liquid metal which extends from a region of the wall of the mould located in the vicinity of the input end of the die space and converges from said region of the wall of the mould toward the wall of the core and reaches a point of the core substantially at but no lower than the output end of the die space, contact of the core with the solidified part of the cast metal ceasing at substantially said output end of the die space.

2. A process as claimed in claim 1, comprising, at the beginning of the pouring of the metal, heating the core while maintaining an annular water jacket around the mould, which jacket is separated from the mould by an annular chamber containing a gas to avoid cooling the mould and then, when the metal has been poured into the annular die space, cooling the mould by supplying a jacket of cooling liquid metal under pressure in said chamber around the mould.

3. An installation for continuously casting a tubular product and more particularly a thin-walled tube, from metal, comprising a mould and a core of graphite which define therebetween an annular die space having an input end and an output end, the core terminating substantially at said output end of the die space, a pouring basin located at the input end of the die space, and rollers located adjacent the output end of the die space for guiding and extracting the solidified tubular product issuing from the die space, means disposed around the mould and defining a jacket of liquid metal and means disposed around the jacket of liquid metal and defining a jacket of water, which jackets cool the mould, a heating device located inside the core and extending from a level adjacent the inlet end of the die space substantially throughout the length of the core but stopping short of the lower end of the core and short of said output end of the die space, and means disposed between the lower end of the heating device and the lower end of the core for maintaining the lower end portion of the core cool.

4. An installation as claimed in claim 3, wherein said means for maintaining cool the lower portion of the core comprise means for circulating cooling water at the lower end of the core.

5. An installation as claimed in claim 3, wherein the core is hollow and the heating device inside the core comprises an inductor substantially in the shape of a coil extending substantially helically along an inner wall of the core, and means defining a cooling water circuit combined with the inductor for cooling the inductor.

6. An installation as claimed in claim 3, wherein the device for heating the core comprises an electric heating resistance, means composed of refractory material insulating the resistance from a lower part of the core, and means for connecting the upper part of the resistance to a circuit supplying electric current of high intensity.

7. An installation as claimed in claim 3, comprising a tank, means for putting the interior of the tank in communication with a source of pressure, and means putting the interior of the tank in communication with a lower part of the cooling liquid metal jacket.

8. An installation as claimed in claim 3, comprising means for putting an upper part of the liquid metal jacket in communication with a source of pressure.

9. An installation as claimed in claim 7, wherein the tank is located below the liquid metal jacket and means are provided for putting an upper part of the liquid metal jacket in communication with the atmosphere.

* * * * *